US007093308B2

(12) United States Patent
Berlovan et al.

(10) Patent No.: US 7,093,308 B2
(45) Date of Patent: Aug. 22, 2006

(54) ELEVATED TOILET SEAT

(75) Inventors: Viorel Berlovan, Medina, OH (US); Laura M. Marker, Akron, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 10/715,089

(22) Filed: Nov. 17, 2003

(65) Prior Publication Data

US 2004/0154085 A1 Aug. 12, 2004

Related U.S. Application Data

(60) Provisional application No. 60/426,860, filed on Nov. 15, 2002.

(51) Int. Cl.
*A47K 13/00* (2006.01)

(52) U.S. Cl. ..... 4/237; 4/239; 4/235; 4/236; 4/240

(58) Field of Classification Search ..... 4/234–237, 4/239, 240, 242.1
See application file for complete search history.

(56) References Cited

U.S. PATENT DOCUMENTS

D237,887 S 12/1975 Landsberger
D242,457 S 11/1976 Landsberger
4,462,122 A 7/1984 Broeils
4,477,932 A 10/1984 Lenosky
D287,399 S 12/1986 Broeils
D287,533 S 12/1986 Broeils
D287,534 S 12/1986 Broeils
5,027,445 A 7/1991 Locarno
5,515,552 A 5/1996 Tolsma
5,666,673 A 9/1997 Ammatelli et al.
5,708,989 A * 1/1998 Ellis ..... 4/237
5,765,236 A 6/1998 Bethanis
5,920,917 A 7/1999 Landsberger
6,012,886 A 1/2000 Tanamura et al.
6,052,838 A 4/2000 Thom et al.
6,101,640 A 8/2000 Brewer et al.
6,338,167 B1 1/2002 Baker et al.
6,381,762 B1 5/2002 Moser
6,643,851 B1 * 11/2003 Janes ..... 4/236

* cited by examiner

*Primary Examiner*—Khoa D. Huynh
(74) *Attorney, Agent, or Firm*—Calfee, Halter & Griswold LLP

(57) ABSTRACT

An elevated toilet seat that includes integral flanges or wings that allow for attachment of one or more external apparatus. The toilet seat is removably attachable to the upper surface of a toilet bowl via a bracket. The seat is snap-fit to the bracket for easy installation and removal.

19 Claims, 5 Drawing Sheets

ELEVATED TOILET SEAT

CROSS REFERENCE TO RELATED APPLICATION

This application claims the benefit of U.S. Provisional Application Ser. No. 60/426,860, filed Nov. 15, 2002.

BACKGROUND OF THE INVENTION

This invention relates to toilet seats and is particularly concerned with an elevated seat that is removably attachable to both standard round and elongated toilet bowls.

Toilet seats are common household fixtures. However, many people may have temporary or permanent physical impairments that make reaching the seat difficult. These people, particularly the elderly, may have difficulty utilizing the muscles required to safely reach the toilet seat, possibly resulting in harm to the user. Modifications to standard toilet seats have been created to attempt to ease the strain on those who are unable to comfortably reach a standard seat. While traditional modifications may be useful in some situations, they are not designed to serve multiple purposes, particularly those outlined below.

Some prior art toilet seats include handles that may be designed to steady a person who requires help in safely using the seat. However, these toilet seats are primarily designed to steady the user once he or she reaches the seat itself. These seats do not also steady the user while the seat is in use. Other prior art toilet seats have handles designed primarily for sanitary purposes. However, again, these prior art toilet seats do not aid the user both in safely reaching the toilet seat and in maintaining steady balance while using the toilet. Further, these prior art seats have handles that are permanently affixed to the toilet seat, which may not be desirable where a user is extremely overweight, or where he or she requires devices to aid in movement, such as a wheelchair. Therefore, there is a strong need for a toilet seat that can assist people both in reaching the toilet seat and in remaining steady while using the seat by providing multiple, removable handles designed to aid the balance of the user.

Other prior art toilet seat modifiers provide a raised portion to allow the user with physical impairments to reach the toilet seat with less exertion than that required by standard seats. These raised toilet seats ease the work required by assuming a standard sitting position. However, traditional elevated toilet seats do not provide handles for both stabilization while approaching the seat and while sitting on the seat. Further, the prior art toilet seats are oftentimes bulky and may be unstable, creating an even greater risk of injury to a user by not maintaining position on the toilet rim. Therefore, there is a need for a stable, elevated toilet seat.

Another problem associated with prior art toilet seats involves the difficulty in their installation and removal. Those with impairments may require assistance from others, many of whom may prefer standard toilet seats. However, traditionally, in order to stabilize the toilet seat, a user must affix the entire seat with a mechanism such as a bolt, requiring the use of tools whenever the seat is to be installed or removed. This added exertion makes traditional modified toilet seats impractical in households in which not all users are impaired. There is a strong need for a toilet seat that aids those in need, while at the same time is easily installed and removed without the need for tools after initial installation.

Further, many people who have difficulty with movement cannot easily reach other items associated with use of a toilet, such as tissue, medications or other toiletries. Traditional toilet seats fail to address this issue, as the bulk of the seat often prohibits the addition of receptacles designed to hold a user's necessary items. As such, there is a need for these items to be within reach at all times, creating a desire for a way to attach auxiliary items, such as a basket, to a modified toilet seat.

Accordingly, the present invention addresses these needs.

SUMMARY OF THE INVENTION

The present invention is directed to an elevated toilet seat and a bracket for attaching it to a toilet bowl. One of the objects of the invention is an elevated toilet seat and bracket therefore which accommodate the wide variation in the geometry of both round and elongated toilet bowls. The connection of the seat to the bracket uses a snap-fit construction which allows easy installation or removal by end users at a low cost to the manufacturer. Optionally the elevated seat bracket can be installed on a toilet base along with a standard toilet seat, so that the existing seat can be used upon removal of the elevated toilet seat.

The elevated toilet seat of the present invention has a seating ring of the usual shape and dimensions. The seating ring includes a riser. The riser engages the top rim of the toilet bowl and elevates the seating surface. A pair of flanges or wings extends from the sides of the seating ring, and may further include mounting openings for armrests and/or handles and for a utility basket. The rear edge of the ring contains a receiving member integral to the ring that is capable of receiving a mounting bracket. The mounting bracket is removably attachable to a standard toilet bowl. The bracket extends into the perimeter of the toilet bowl so it can engage the receiving member of the ring. The receiving member/bracket mechanism permits the elevated seat to be selectably removed from the bowl by lifting the seat up straight up and pulling it out.

DETAILED DESCRIPTION OF THE INVENTION

Figure 2:
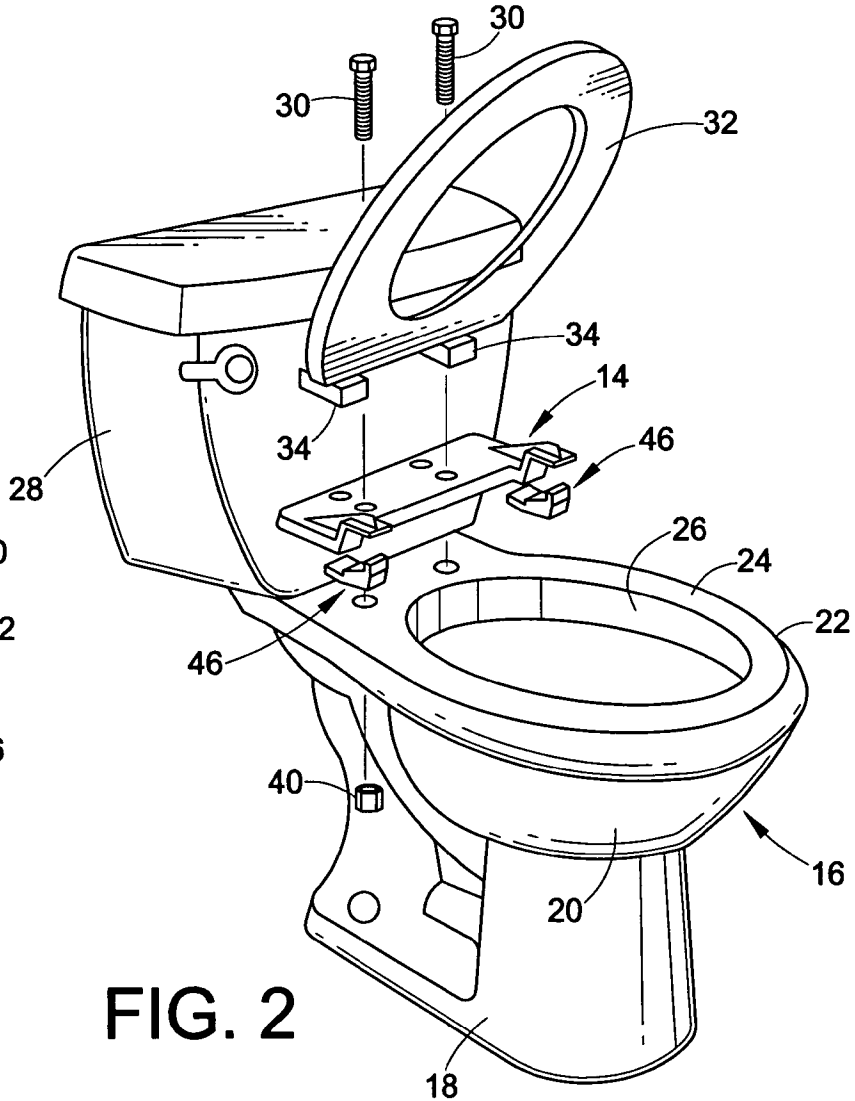
FIG. 2 is an exploded perspective view of the mounting bracket of the present invention and a standard toilet seat but with the elevated seating ring removed.
Figure 1:
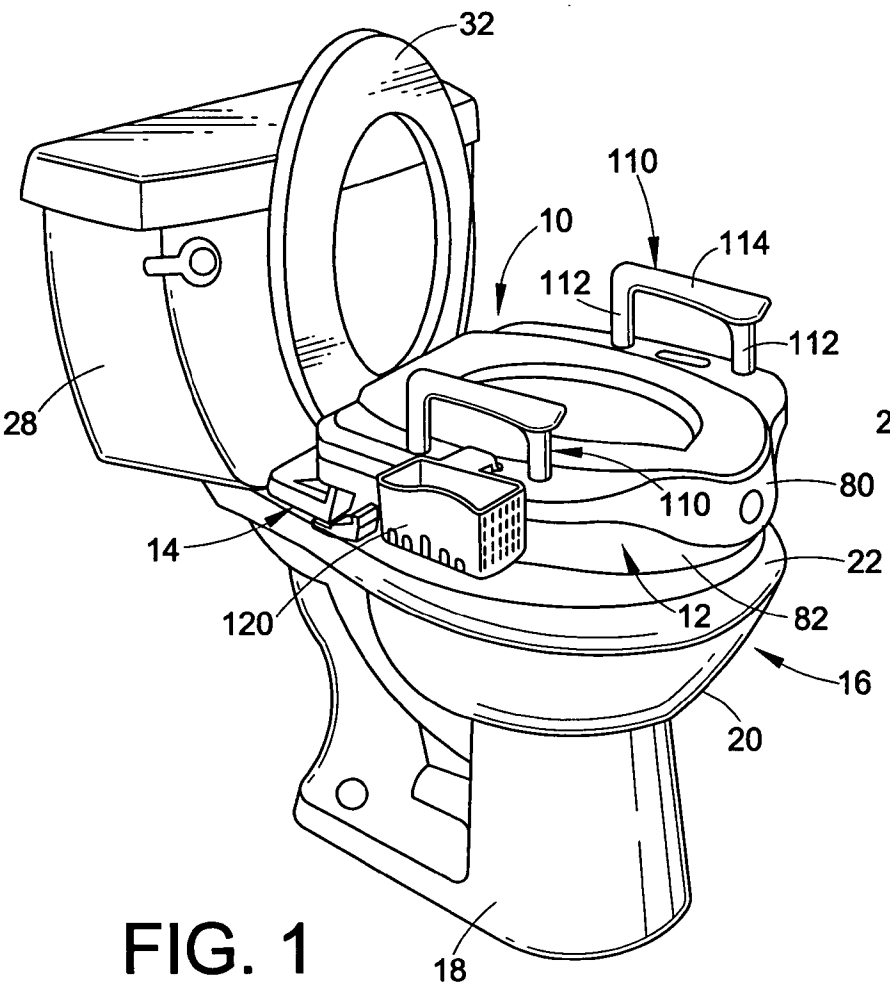
FIG. 1 is a perspective view of the elevated toilet seat assembly of the present invention mounted on a toilet.
Figure 3:
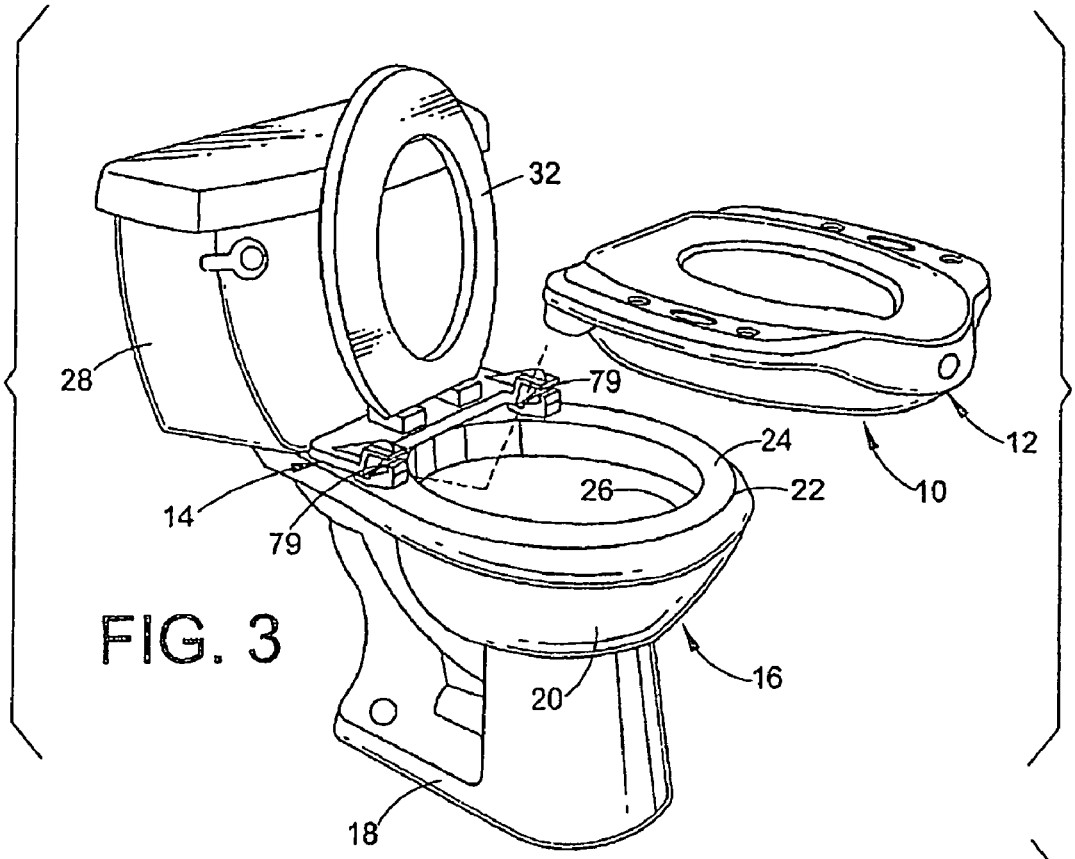
FIG. 3 is an exploded view of the elevated toilet seat assembly with the elevated seating ring above the rim of the bowl.
Figure 4:
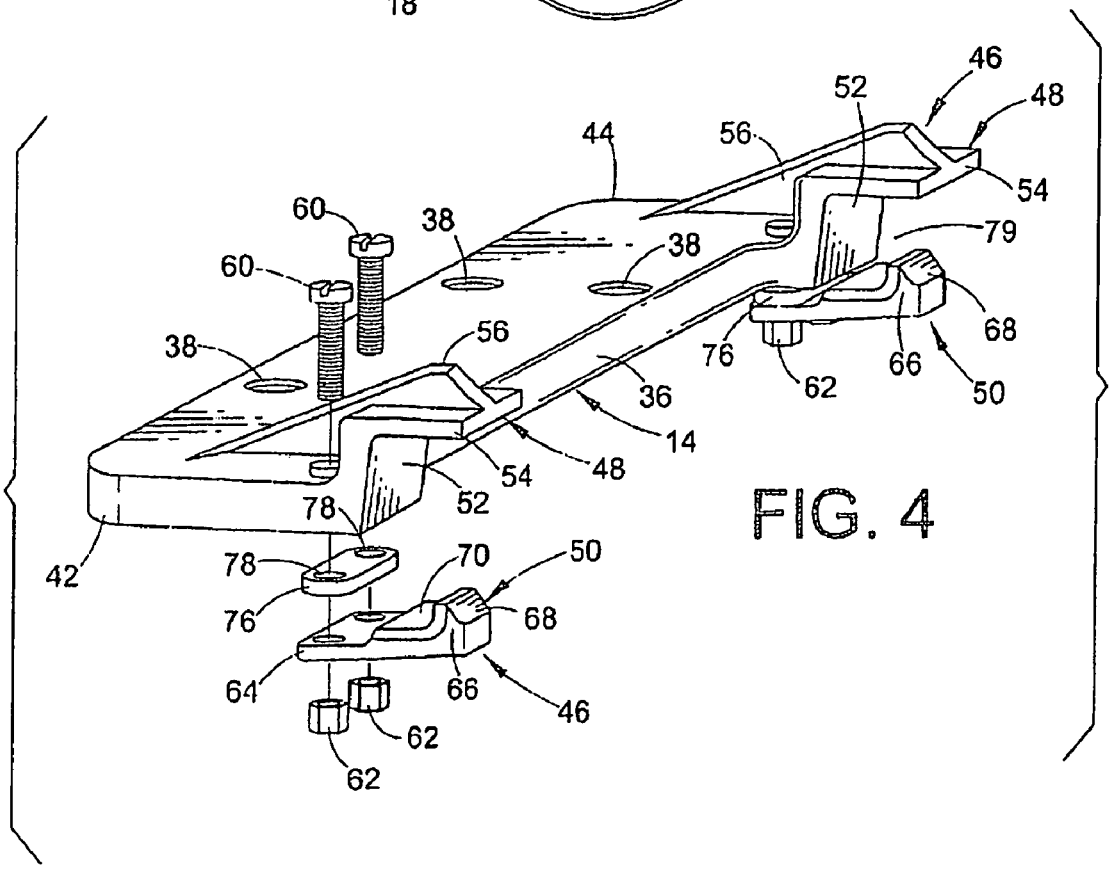
FIG. 4 is an enlarged, exploded perspective view of the mounting bracket.

FIGS. 1–3 illustrate the elevated toilet seat assembly of the present invention generally at 10. The toilet seat assembly has two major components, a seating ring 12 and a mounting bracket 14. The seating ring 12 has the usual shape and dimensions for supporting a user on a toilet. The mounting bracket 14 is attached to a toilet bowl. The seating ring 12 is removably mountable on the toilet bowl and is retained thereon by releasable engagement with the mounting bracket 14. This engagement will be explained further below.

FIG. 2 shows a conventional toilet 16 and the mounting bracket 14 installed thereon. The toilet includes a base 18 supporting a bowl 20. The top of the bowl has an upper rim 22 that includes a top land 24. The rim defines an opening 26 which in this case has an oval shape. The oval opening has a major diameter and a minor diameter. The bowl 20 may be connected to the usual water closet shown at 28. The mounting bracket 14 rests on the top land 24 of the rim at the rear edge thereof. It is retained in place by bolts 30. As shown in this embodiment the bolts 30 may also mount a conventional toilet seat 32. The hinges 34 of the seat 32 may rest on top of the bracket 14 and the bolts 30 extend through the hinges to retain the conventional seat.

Details of the mounting bracket 14 are evident in FIGS. 4–8. The mounting bracket 14 is an elongated plate having a central, relatively flat body or base portion 36. Mounting holes 38 are formed in the body portion. These holes 38 are located on the same template as the standard holes in the toilet bowl rim 22 so that holes 38 will line up with the holes in the bowl. Bolts 30 (FIG. 2) extend through these holes 38 and are retained by nuts 40 to fasten the mounting bracket 14 to the toilet bowl 20. The mounting bracket further includes end portions 42, 44 which join the base portion 36. The length of the base portion 36 is such that the end portions 42, 44 are located beyond the outer perimeter of the toilet bowl when the mounting bracket is installed on a toilet bowl. This is important for providing a solid foundation for the attachment elements which will now be described.

Attached to the front edge of the end portions 42, 44 are two first attachment elements 46. Each first attachment element has a jaw 48 and a latch 50. The jaw is formed by an upright support 52 and a horizontal plate 54. As can be seen the support 52 extends upwardly from one of the end portions 42 or 44 and the plate 54 extends outwardly from the top edge of the support 52. The support 52 and plate 54 are reinforced by a gusset 56. Immediately behind the support 52 and on either side of the gusset 56 are a pair of holes 58. These receive attachment bolts 60 (FIG. 4) which, together with nuts 62, fasten the latch 50 to the underside of the end portion of the mounting bracket.

Figure 9:
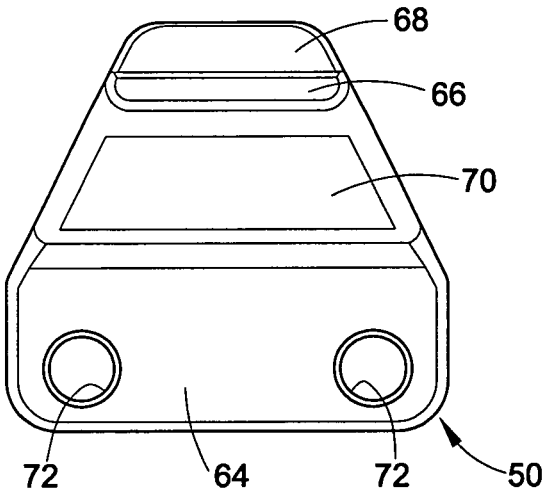
FIG. 9 is a top plan view of a latch.
Figure 10:
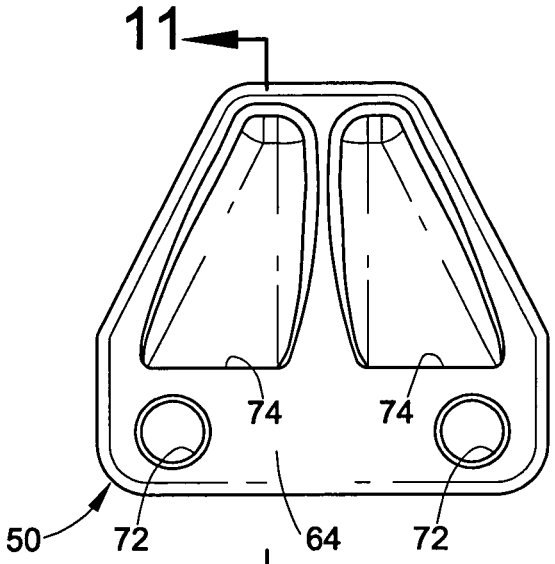
FIG. 10 is a bottom plan view of a latch.
Figure 11:
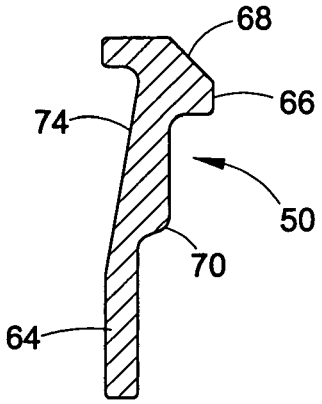
FIG. 11 is a section taken along line 11—11 of FIG. 10.

Details of the latch 50 are shown in FIGS. 9–11. The latch includes a base plate 64 and an upstanding pawl 66. The front edge of the pawl is beveled as at 68. A central ledge 70 is formed on the base plate and bolt holes 72 are formed in the plate behind the ledge. There are depressions 74 on the underside of the plate 64. An elastomeric spacer 76 has holes 78 therein aligned with the holes 72 and 58 for receiving the bolts 60. The spacer 76 provides a cushion between the latch 50 and the end portions 42, 44 to allow for some flexure of the latch during insertion and removal of the seating ring's attachment elements. It can be seen that the jaw and latch extend from the mounting bracket's end portions-in facing, spaced relation to one another that defines a receiving socket 79 (FIGS. 3 and 4) between them.

Turning now to the seating ring 12, FIGS. 5, 6 and 12–14 illustrate the details of the seating ring. The ring comprises two main parts, a shell 80 and a riser 82. The shell sits on top of the riser and is attached thereto or is integrally formed therewith. The shell is the portion of the seating ring which the user will contact. The shell 80 includes a generally oval upper seating surface 84 which defines a central opening 86. A front skirt 88 depends from the front edge of the seating surface 84. The skirt 88 and seating surface 84 merge with first and second flanges or wings 90, 92 on either side of the seating ring. The flanges extend outwardly from the seating surface 84 such that the flanges will lie substantially outside the perimeter of the toilet bowl rim 22 when the seat is mounted on the bowl 20.

Figure 12:
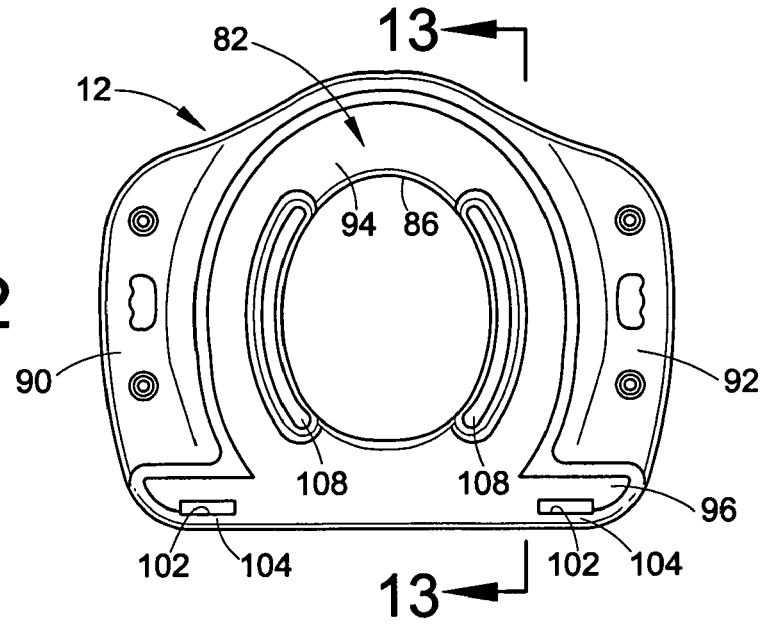
FIG. 12 is a bottom plan view of the seating ring.
Figure 13:
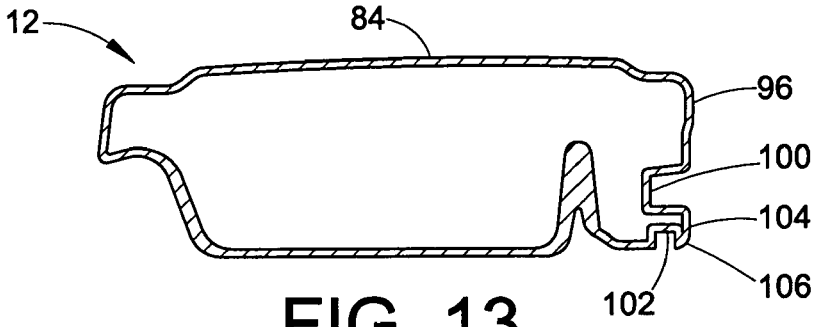
FIG. 13 is a section taken along line 13—13 of FIG. 12.
Figure 14:
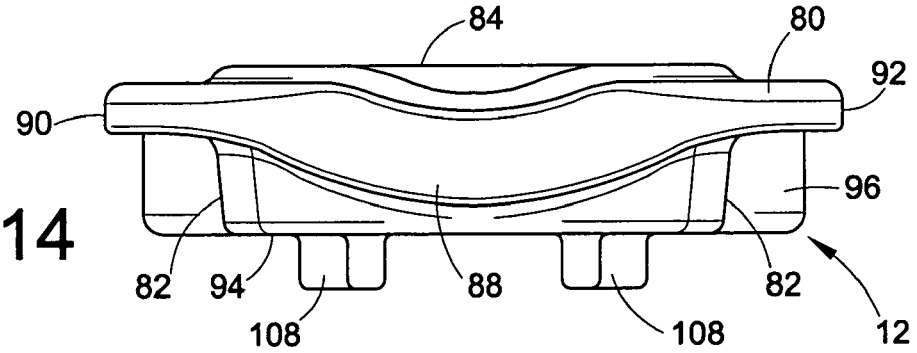
FIG. 14 is a front elevation view of the seating ring.
Figure 15:
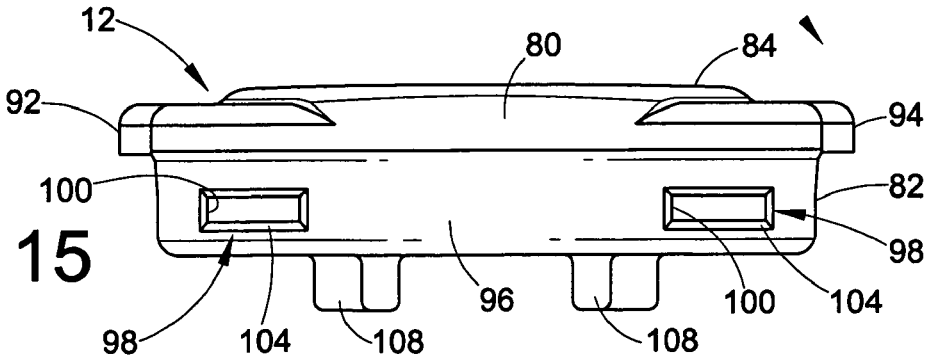
FIG. 15 is a rear elevation view of the seating ring.

As seen in FIG. 12, the riser 82 has a generally oval portion 94 joining a laterally extending shoulder 96 at the rear of the seating ring. The shoulder has formed therein two second attachment elements 98. The second attachment elements each include a receptacle 100 and a pocket 102, both formed as indentations in the shoulder 96. The receptacle and pocket define a bar or catch 104 between them. A lip 106 (FIG. 13) is formed on the underside of the catch for engagement with the pawl 66 of the latch 50. The latch 50 is flexible due to the movement allowed by the spacer 76. This movement allows the second attachment elements 98 to engage the first attachment elements 46 in a snap fit. This is done by inserting the jaws 48 into the receptacles 100 and pivoting the ring 12 down and back until the lip 106 slides up over the beveled edge 68 on the pawl 66 and snaps in behind the pawl. The pawl then resides in the pocket 102. To remove the ring 12, it is lifted until the catch 104 is released from the pawl 66 and then the ring can be pulled away from the toilet.

It will be noted that the oval portion 94 of the riser does not extend laterally underneath the flanges 90, 92 but instead follows the shape of the toilet bowl and thus, remains inside of the flanges. It can best be seen in FIG. 14 that the flanges 90, 92 are, in effect, cantilevered from the riser 82. The oval portion 94 also has two crescent-shaped extensions 108. Together the extensions define a partial oval that has a slightly reduced major and minor outer diameter compared to those of the oval portion 94. This permits the extensions 108 to fit inside the inner diameter of the toilet bowl's rim 22. Thus, the bottom surface of the oval portion 94 sits on the top land 24 of the toilet bowl rim while the extensions 108 fit just inside the rim 22. The extensions 108 extend slightly into the bowl in telescoping relation. The extensions therefore prevent the riser 82 from shifting laterally or otherwise slipping off the top of the bowl. The riser oval portion 94 can have a thickness (that is, a vertical height) of anywhere from an inch or so to six to eight inches or more, depending on the amount of elevation desired.

The flanges 90, 92 have a thickness that allows sufficient reinforcing ribs (not shown) on their underside so that the flanges can be weight bearing, i.e., a user can put his or her hands on the flanges to assist in lowering themselves or in standing up. Preferably the user will put his or her weight on a pair of arm rests, shown in FIG. 1 at 110. The arm rests have upright legs 112 with pegs of reduced diameter at the bottom of the legs. The tops of the legs are joined by a handle or grip portion 114. The pegs can be mounted in receptacles 116 (FIG. 5) that are formed in the flanges 90, 92. A user can put his or her hands on the handle grip portion 114 to push up from the seat, or to lower themselves onto the seat.

Figure 5:
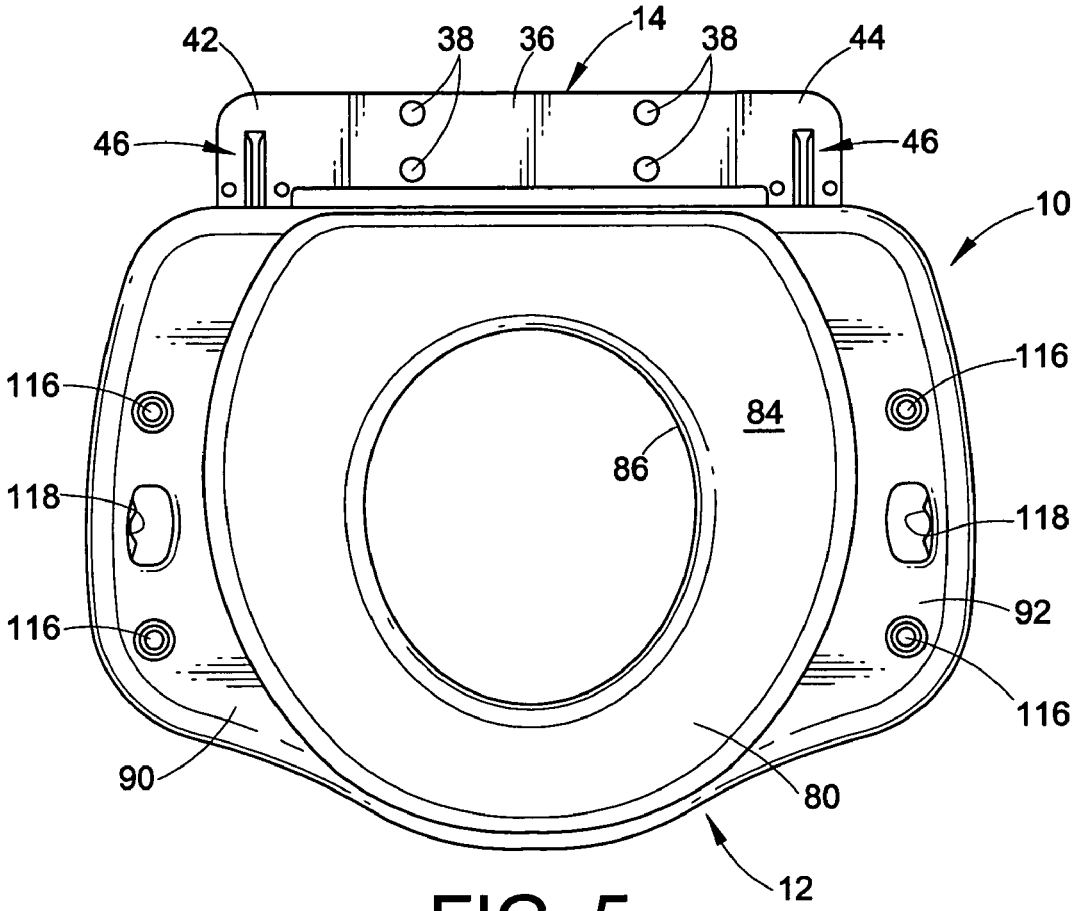
FIG. 5 is a top plan view of the elevated toilet seat assembly of the present invention.
Figure 6:
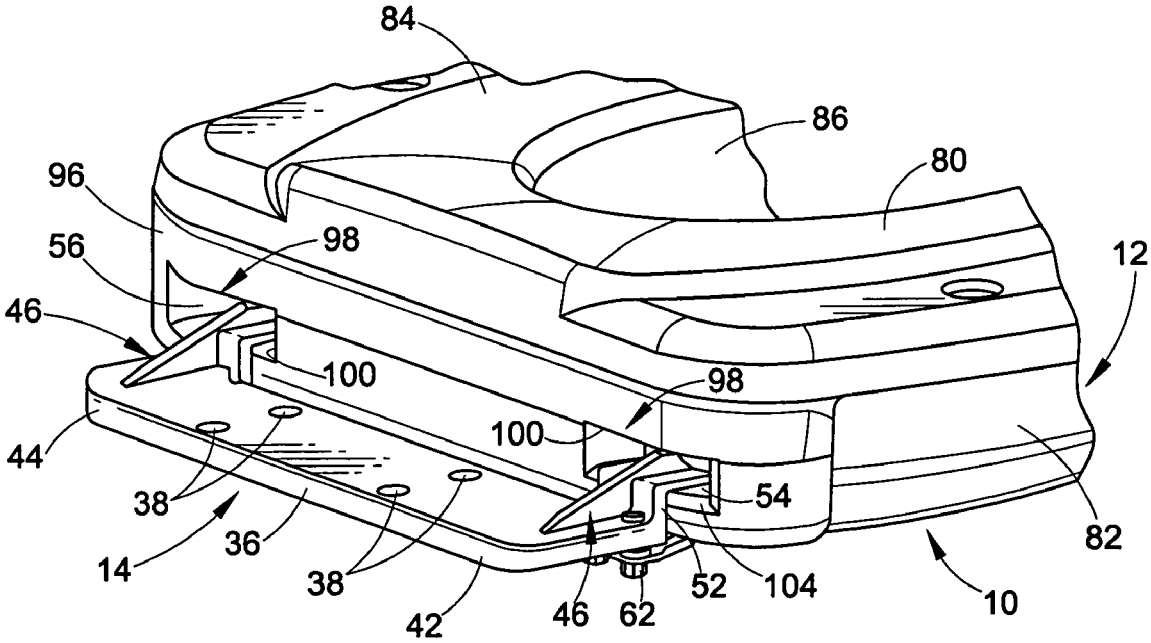
FIG. 6 is a rear perspective view of the elevated toilet seat assembly.
Figure 7:
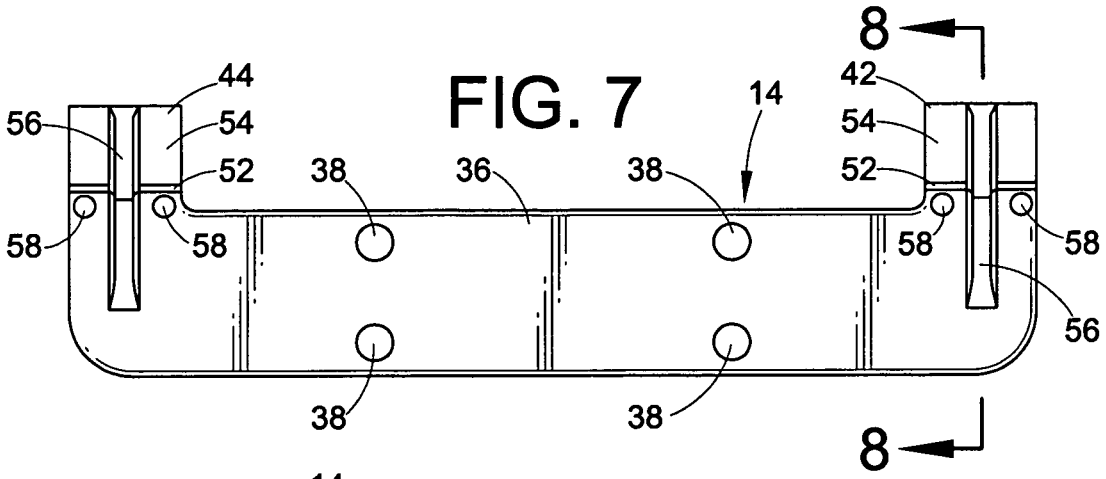
FIG. 7 is a top plan view of the mounting bracket.
Figure 8:
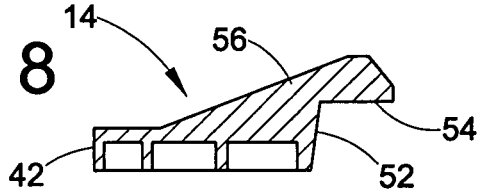
FIG. 8 is a section taken along line 8—8 of FIG. 7.

As seen in FIG. 5, the flanges 90, 92 each have a further central socket 118 that can receive a mounting bracket of an optional auxiliary basket 120. The basket includes a container portion. The basket's mounting bracket suspends the container over the side of the flanges 90, 92. The container can hold whatever items are desired to have conveniently stored nearby.

It can be seen that the elevated toilet seat as described provides several advantages for users who have difficulty sitting and standing. The riser 82 raises the height of the shell 80 so that a user need not sit as far down to be supported on the seating ring. This helps prevent accidents resulting from a user basically falling onto the toilet. Then, because the user is sitting up higher, there is less difficulty in standing up from the seat. The arm rests 110 also allow the user to use his or her arms to assist in rising to a standing position. Having the handles on the seat precludes the need to find a nearby structure on which to push off. The arrangement of the flanges and bracket helps distribute the load more evenly around the rim of the toilet. If a user is putting weight on the handles, much of that load is transferred to the mounting bracket 14 and thus to the rear edge of the toilet bowl.

It will be understood that the embodiments of the present invention which have been described are illustrative of some of the principles and applications of the present invention. Numerous modifications may be made by those skilled in the art without departing from the true spirit and scope of the invention. For example, while the first and second attachment elements are shown as a male clamping arrangement received in a female catch, the attachment elements could have other configurations of interengaging members. It is preferred that the attachment elements not involve any separate fasteners such as bolts, pins or the like.

We claim:

1. An elevated toilet seat assembly mountable on a toilet bowl having an upper rim, the toilet seat assembly comprising:

a mounting bracket having a base portion connectable to the toilet bowl, at least on end portion attached to the base portion and extending beyond the perimeter of the upper rim when the mounting bracket is attached to the toilet bowl, and a first attachment element connected to the end portion of the mounting bracket; and a seating ring including a riser engageable with the upper rim of the toilet bowl, and a second attachment element releasably engageable with the first attachment element;

wherein the first attachment element comprises a jaw and a latch extending from the end portion of the bracket in spaced relation to one another to define a receiving socket therebetween.

2. The toilet seat assembly of claim 1 wherein one of the jaw and latch is flexible to permit entry and exit of the second attachment element to and from the receiving socket.

3. The toilet seat assembly of claim 1 wherein the second attachment element comprises a catch formed on the seating ring for releasable engagement with the jaw and latch by means of entry to and exit from the receiving socket.

4. The toilet seat assembly of claim 3 wherein the seating ring includes a receptacle for receiving the jaw and a pocket for receiving the latch, the catch being defined between the receptacle and the pocket.

5. The toilet seat assembly of claim 1 wherein the latch comprises a base plate and an upstanding pawl connected to the base plate.

6. The toilet seat assembly of claim 5 wherein the pawl extends toward the jaw.

7. The toilet seat assembly of claim 6 wherein the pawl has a front edge that is beveled on the side opposite the receiving socket.

8. An elevated toilet seat assembly mountable on a toilet bowl having an upper rim, the toilet seat assembly comprising:

a) a mounting bracket having a base portion connectable to the toilet bowl, and a first attachment element; and b) a seating ring including a riser engageable with the upper rim of the toilet bowl, and a second attachment element releasably engageable with the first attachment element, one of the first and second attachment element comprising a jaw and a latch extending in spaced relation to one another to define a receiving socket therebetween, and the other of the first and second attachment elements comprising a catch for releasable engagement with the jaw and latch by means of entry to and exit from the receiving socket.

9. The toilet seat assembly of claim 8 wherein the mounting bracket further comprises first and second end portions attached to the base portion opposite said one end portion.

10. The toilet seat assembly of claim 9 further comprising an additional first attachment element, the two first attachment elements being connected to the first and second end portions, and an additional second attachment element formed on the seating ring, the two second attachment elements being releasably engageable with the first attachment elements.

11. The toilet seat assembly of claim 10 wherein the first attachment elements are spaced apart from one another sufficiently to provide access to the base portion for attachment of a standard toilet seat.

12. The toilet seat assembly of claim 8 wherein one of the jaw and latch is flexible to permit entry and exit of the second attachment element to and from the receiving socket.

13. The toilet seat assembly of claim 12 further comprising an elastomeric pad disposed between the base portion and said one of the jaw and latch.

14. The toilet seat assembly of claim 8 wherein said other of the first and second attachment elements includes a receptacle for receiving the jaw and a pocket for receiving the latch, the catch being defined between the receptacle and the pocket.

15. The toilet seat assembly of claim 8 wherein the latch comprises a base plate and an upstanding pawl connected to the base plate.

16. The toilet seat assembly of claim 15 wherein the pawl extends toward the jaw.

17. The toilet seat assembly of claim 16 wherein the pawl has a front edge that is beveled on the side opposite the receiving socket.

18. An elevated toilet seat for removable engagement with a toilet bowl having an upper rim, said toilet seat comprising:

a) a mounting bracket removably attachable to the toilet bowl and including a first attachment element; and b) a seating ring including a riser, a second attachment element and a pair of wings extending from the sides of said seating ring, the first attachment element being releasably engageable with the second attachment element, wherein the first attachment element comprises a jaw and a latch.

19. The elevated toilet seat of claim 18 wherein the latch is removably attached to the mounting bracket.

* * * * *

UNITED STATES PATENT AND TRADEMARK OFFICE

CERTIFICATE OF CORRECTION

PATENT NO. : 7,093,308 B2
APPLICATION NO. : 10/715089
DATED : August 22, 2006
INVENTOR(S) : Berlovan et al.

It is certified that error appears in the above-identified patent and that said Letters Patent is hereby corrected as shown below:

In Claim 1, at column 5, line 39, "on" should read --one--

Signed and Sealed this

Twenty Second Day of April, 2008

JON W. DUDAS
*Director of the United States Patent and Trademark Office*